US008985485B2

(12) United States Patent
Budai et al.

(10) Patent No.: US 8,985,485 B2
(45) Date of Patent: Mar. 24, 2015

(54) QUASI MELT BLOW DOWN SYSTEM

(75) Inventors: Michael B. Budai, Old Hickory, TN (US); Edward W. Bolyard, Jr., Old Hickory, TN (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 13/547,685

(22) Filed: Jul. 12, 2012

(65) Prior Publication Data

US 2013/0084388 A1 Apr. 4, 2013

Related U.S. Application Data

(60) Provisional application No. 61/542,497, filed on Oct. 3, 2011.

(51) Int. Cl.

| | |
|---|---|
| ***B05B 1/14*** | (2006.01) |
| ***B05C 5/02*** | (2006.01) |
| ***D01D 4/02*** | (2006.01) |
| ***D01D 5/098*** | (2006.01) |

(52) U.S. Cl.

CPC ..... *B05C 5/0245* (2013.01); *D01D 4/025* (2013.01); *D01D 5/0985* (2013.01)

USPC ..... 239/555; 239/296; 239/553; 239/590.3

(58) Field of Classification Search

CPC ..... B05C 5/0245; B05B 1/14; B05D 1/26

USPC ..... 427/180; 239/553.5, 555, 296, 299, 239/406, 553

See application file for complete search history.

(56) References Cited

U.S. PATENT DOCUMENTS

| | | | | |
|---|---|---|---|---|
| 3,176,345 | A | 4/1965 | Powell | |
| 3,192,562 | A * | 7/1965 | Powell | 425/131.5 |
| 5,679,379 | A * | 10/1997 | Fabbricante et al. | 425/7 |
| 6,602,554 | B1 * | 8/2003 | Kwok | 427/424 |
| 7,798,434 | B2 * | 9/2010 | Bondeson et al. | 239/601 |

FOREIGN PATENT DOCUMENTS

| | | | |
|---|---|---|---|
| EP | 0835952 | A1 | 4/1998 |
| EP | 0872580 | A1 | 10/1998 |
| EP | 0979885 | A2 | 2/2000 |
| EP | 1116521 | A2 | 7/2001 |
| EP | 1166890 | A2 | 1/2002 |
| WO | 9954057 | A1 | 10/1999 |

OTHER PUBLICATIONS

International Search Report for PCT/US2012/058380, dated Jan. 25, 2013.

* cited by examiner

*Primary Examiner* — Jason Boeckmann

(74) *Attorney, Agent, or Firm* — Levenfeld Pearlstein, LLC

(57) ABSTRACT

A melt blown system for adding a fine fiber layer to a substrates includes a die assembly, a first channel in the die assembly for carrying a first fluid, a first cavity fluidically coupled to the first channel that is configured to collect the first fluid, a first orifice for carrying a second fluid through the die assembly which is fluidically coupled to a second orifice in the die assembly by at least one channel, a plurality of first nozzles in the die assembly that are fluidically coupled to the first orifice, a plurality of second nozzles in the die assembly that are fluidically coupled to the second orifices, and a plurality of third nozzles in the die assembly that are fluidically coupled to the first cavity.

12 Claims, 9 Drawing Sheets

QUASI MELT BLOW DOWN SYSTEM

CROSS-REFERENCE TO RELATED APPLICATION DATA

This application claims the benefit of priority of Provisional U.S. Patent application Ser. No. 61/542,497, filed, Oct. 3, 2011, the disclosure of which is incorporated herein by reference.

BACKGROUND

Nonwoven fabrics are engineered fabrics that provide specific functions such as absorbency, liquid repellence, resilience, stretch, softness, strength, flame retardant protection, easy cleaning, cushioning, filtering, use as a bacterial barrier and sterility. In combination with other materials the materials can provide a spectrum of products with diverse properties, and can be used alone or as components of apparel, home furnishings, health care, engineering, industrial and consumer goods.

Nonwoven fabrics are typically manufactured by combining small fibers in the form of a sheet or web (similar to paper on a paper machine), and then binding the fibers either mechanically (as in the case of felt, by interlocking them with serrated needles such that the inter-fiber friction results in a stronger fabric), with an adhesive, or thermally by applying a binder in the form of powder, paste, or polymer melt and melting the binder onto the web by increasing temperature.

Spunlaid nonwoven fabrics are made in one continuous process. In this process, polymer granules are melted and the molten polymer is extruded through spinnerets. The continuous filaments are cooled and deposited on to a conveyor to form a uniform web. Residual heat can cause filaments to adhere to one another, but is not regarded as the principal method of bonding.

Meltblown nonwoven fabrics are made by extruding low viscosity polymers into a high velocity airstream upon leaving a spinneret which scatters the melt, solidifies it and breaks it up into a fibrous web. Current spunlaid and meltblown systems have a prohibitively high cost, consume large amounts of energy and experience maintenance problems due to nozzles clogging during operation. These system also have lower production rates because they are limited by the volumetric output of grams per hole per minute (throughput rate). Accordingly, a need exists for a low cost, easily maintained system for forming nonwoven fabrics.

SUMMARY

Various embodiments of the present disclosure provide a melt blown system including a die assembly, a first channel in the die assembly for carrying a first fluid, a first cavity fluidically coupled to the first channel that is configured to collect the first fluid, a first orifice for carrying a second fluid through the die assembly which is fluidically coupled to a second orifice in the die assembly by at least one channel, a plurality of first nozzles in the die assembly that are fluidically coupled to the first orifice, a plurality of second nozzles in the die assembly that are fluidically coupled to the second orifices, and a plurality of third nozzles in the die assembly that are fluidically coupled to the first cavity.

Another embodiment of the present disclosure provides a method of adding fine fiber layers to a web or an existing substrate by discharging a first fluid from a plurality of first nozzles that are each fluidically coupled to a cavity containing the first fluid, discharging a second fluid from a plurality of second nozzles that are, each coupled to a first orifice containing the second fluid, discharging the second fluid from a plurality of third nozzles that are each fluidically coupled to a second orifice which is fluidically coupled to the first orifice.

Other objects, features, and advantages of the disclosure will be apparent from the following description, taken in conjunction with the accompanying sheets of drawings, wherein like numerals refer to like parts, elements, components, steps, and processes.

DETAILED DESCRIPTION

Figure 1A:
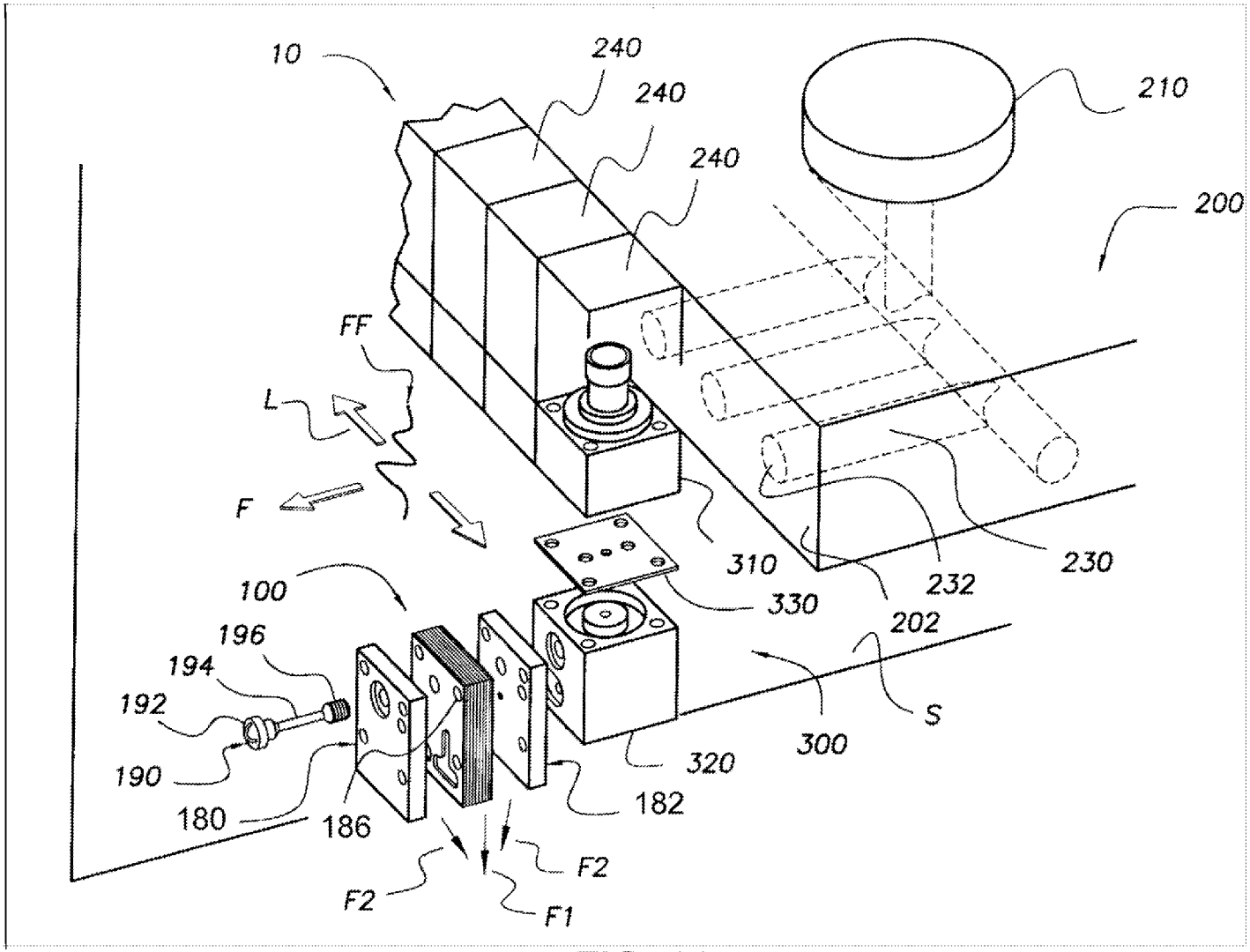
FIG. 1A illustrates an embodiment of a quasi melt blow down system.

While the present disclosure is susceptible of embodiment in various forms, there is shown in the drawings and will hereinafter be described one or more embodiments with the understanding that the present disclosure is to be considered illustrative only and is not intended to limit the disclosure to any specific embodiment described or illustrated.

FIG. 1A is a quasi melt blow down system 10 useable for dispensing fluids, and particularly metallocene based thermoplastic polymers, onto a substrate movable in a first direction F relative thereto. The metallocene based thermo-plastic polymers can include, for example, polypropylene, polyethylene, nylon 6 and some polyesters. The system 10 extrudes fine fibers (e.g., less than 5 microns in size) and at volumes greater than about 0.2 to 0.8 grams per slit per minute. In an embodiment, the fluids are used to add fine fibers layers to a substrate, for example, a non-woven.

Figure 1B:
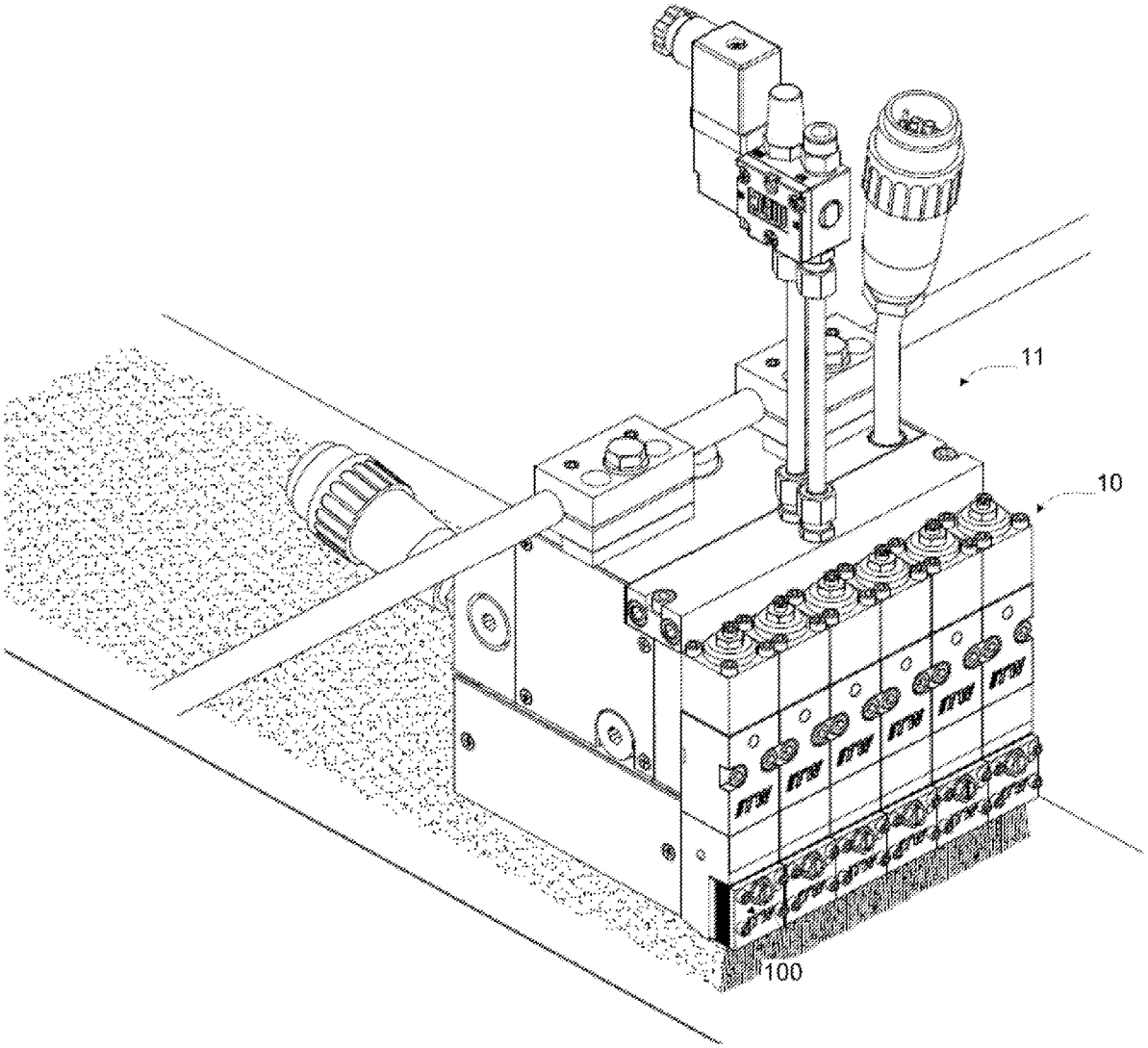
FIG. 1B illustrates the quasi melt blow down system of FIG. 1A incorporated into a uniform fiber deposition system.

FIG. 1B shows the quasi melt blow down system 10 dispensing first and second fluids on top of a previously melt blown or spunlaid fabric as a separate nonwoven layer. The melt blow down system 10 is incorporated into a uniform fiber deposition system 11 such as, but not limited to, a LPT/UFD™—Fiberized Spray Applicator manufactured by Illinois Tool Works of Glenview, Ill. The first and second fluids are delivered to, and dispensed from, the die assemblies 100 as discussed herein.

The system includes generally one or more die assemblies 100, an exemplary one of which is shown having at least two parallel plates 180 and 182 coupled to a manifold 200, having associated therewith a fluid metering device 210 for supplying a first fluid to the one or more die assemblies 100 through corresponding first fluid supply conduits 230. The system also has the capacity to supply a second fluid, such as heated air, to the die assemblies as discussed more fully in the referenced in Bolyard, Jr., U.S. Pat. No. 5,862,986, which is commonly assigned with the present application and is incorporated herein by reference in its entirety.

According to one aspect, as shown schematically in FIG. 1A, a first fluid is dispensed from a first slit 152 of the die assembly 100 to form a first fluid flow F1 at a first velocity, and a second fluid is dispensed from two second slits 154 to form separate second fluid flows F2 at a second velocity along substantially opposing flanking sides of the first fluid flow F1. The first fluid flow F1 is allocated between the second fluid flows. F2 thus forming an array of first and second fluid flows. The second velocity of the second fluid flows F2 are generally greater than the first velocity of the first fluid flow F1, so that the second fluid flows F2 draw the first fluid flow F1 downward, such that the drawn first fluid flow F1 is attenuated to form a first fluid filament. In the exemplary embodiment, the second fluid flows F2 are directed convergently toward the first fluid flow F1, but more generally the second fluid flows F2 are directed non-convergently relative to the first fluid flow F1 in parallel or divergently as disclosed more fully in Kwok, U.S. Pat. No. 5,904,298, which is commonly assigned with the present application and which is incorporated herein by reference in its entirety.

More generally, the first fluid is dispensed from a plurality of first slits 152 to form a plurality of first fluid flows F1, and the second fluid is dispensed from a plurality of second slits 154 to form a plurality of second fluid flows F2. The plurality of first fluid flows and the plurality of second fluid flows are arranged in a series. In convergently directed second fluid flow configurations, the plurality of first fluid flows F1 and the plurality of second fluid flows F2 are arranged in a series so that each of the plurality of first fluid flows F1 is flanked on substantially opposing sides by corresponding convergently directed second fluid flows F2 as shown in FIG. 1A, i.e. F2 F1 F2 F2 F1 F2. In non-convergently directed second fluid flow configurations, the plurality of first fluid flows F1 and the plurality of second fluid flows F2 are arranged in an alternating series so that each of the plurality of first fluid flows F1 is flanked on substantially opposing sides by one of the second fluid flows F2, i.e. F2 F1 F2 F1 F2, as disclosed more fully in the aforementioned patent to Kwok. The second velocity of each of the plurality of second fluid flows F2 is generally greater than the first velocity of each of the plurality of first fluid flows F1, such that the plurality of second fluid flows F2 draw each of the plurality of first fluid flows F1 downward, wherein the drawn plurality of first fluid flows F1 are attenuated to form a plurality of first fluid filaments. The plurality of first fluid flows F1 are generally alternatively directed divergently, or in parallel, or convergently.

According to another aspect, the plurality of first fluid flows F1 are dispensed from the plurality of first slits 152 at approximately the same first fluid mass flow rate, and the plurality of second fluid flows F2 are dispensed from the plurality of second slits 154 at approximately the same second fluid mass flow rate. The mass flow rates of the plurality of first fluid flows F1, however, are not necessarily the same as the mass flow rates of the plurality of second fluid flows F2. Dispensing the plurality of first fluid flows F1 at approximately equal first fluid mass flow rates provides improved first fluid flow control and uniform dispensing of the first fluid flows F1 from the die assembly 100, and dispensing the plurality of second fluid flows F2 at approximately equal second fluid mass flow rates ensures more uniform and symmetric control of the first fluid flows F1 with the corresponding second fluid flows F2 as discussed further herein. In one embodiment, the plurality of first slits 152 has approximately equal first fluid flow F1 paths to provide approximately equal first fluid mass flow rates, and the plurality of second slits 154 have approximately equal second fluid flow F2 paths to provide approximately equal second fluid mass flow rates.

In convergently directed second fluid flow configurations, the two second fluid flows F2 are convergently directed toward a common first fluid flow F1 generally having approximately equal second fluid mass flow rates. Although the two second fluid mass flow rates associated with a first fluid flow F1 are not necessarily equal to the two second fluid mass flow rates associated with another first fluid flow F1. In some applications, moreover, the two second fluid flows F2 are convergently directed toward a common first fluid flow F1 that may have unequal second fluid mass flow rates to affect a particular control over the first fluid flow F1 Also, in some applications the mass flows rates of some of the first fluid flows F1 are not approximately equal to the mass flow rates of other first fluid flows F1, for example first fluid flows F1 dispensed along lateral edge portions of the substrate may have a different mass flow rates than other first fluid flows F1 dispensed onto intermediate portions of the substrate to affect edge definition. Thus, while it is generally desirable to have approximately equal mass fluid flow rates amongst first and second fluid flows F1 and F2, there are applications where it is desirable to vary the mass flow rates of some of the first fluid flows F1 relative to other first fluid flows F1, and similarly to vary the mass flow rates of some of the second fluid flows F2 relative to other second fluid flows F2.

FIG. 1A shows a first fluid flow F1 vacillating under the effect of the flanking second fluid flows F2. The first fluid flow F1 vacillation is characterized generally by an amplitude parameter and a frequency parameter, which are controllable, substantially periodically or chaotically, depending upon the application requirements. The vacillation is controllable, for example, by varying a spacing between the first fluid flow F1 and one or more of the second fluid flows F2, by varying the amount of one or more of the second fluid flows F2, or by varying a velocity of one or more of the second fluid flows F2 relative to the velocity of the first fluid flow F1. The amplitude and frequency parameters of the first fluid flow F1 are thus controllable with anyone or more of the above variables as discussed the aforementioned patent to Kwok.

The vacillation of the first fluid flow F1 is also controllable by varying a relative angle between one or more of the second fluid flows F2 and the first fluid flow F1. This method of controlling the vacillation of the first fluid flow F1 is applicable where the second fluid flows F2 are convergent or non-convergent relative to the first fluid flow F1. Convergently directed second fluid flow configurations permit control of first fluid flow F1 vacillation with relatively decreased second fluid mass flow rates in comparison to parallel and divergent second fluid flow configurations, thereby reducing heated air requirements. Generally, the first fluid flow F1 is relatively symmetric when the angles between the second fluid flows F2 on opposing sides of the first fluid flow F1 are approximately equal. Alternatively, the vacillation of the first fluid flow F1 may be skewed laterally in one direction or the other when the flanking second fluid flows F2 have unequal angles relative to the first fluid flow F1 or by otherwise changing other variables discussed herein. According to another aspect, as shown in FIG. 1A, a first fluid flow filament FF from any one of several die assemblies 100 and 240 coupled to the main manifold is vacillated substantially periodically non-parallel to a direction F of substrate S movement.

The corresponding die assembly 100 generally includes a plurality of fluid flow filaments FF arranged in a series with the illustrated filament non-parallel to the direction F of substrate S movement. Still more generally, a plurality of similar die assemblies 240 are coupled to the main manifold 200 in series, and/or in two or more parallel series which may be offset or staggered, and/or non-parallel to the direction F of substrate S movement. In the exemplary application, the plurality of die assemblies 240 and the fluid flow filaments are vacillated in the directions L transversely to the direction F of the substrate S movement.

Figure 1C:
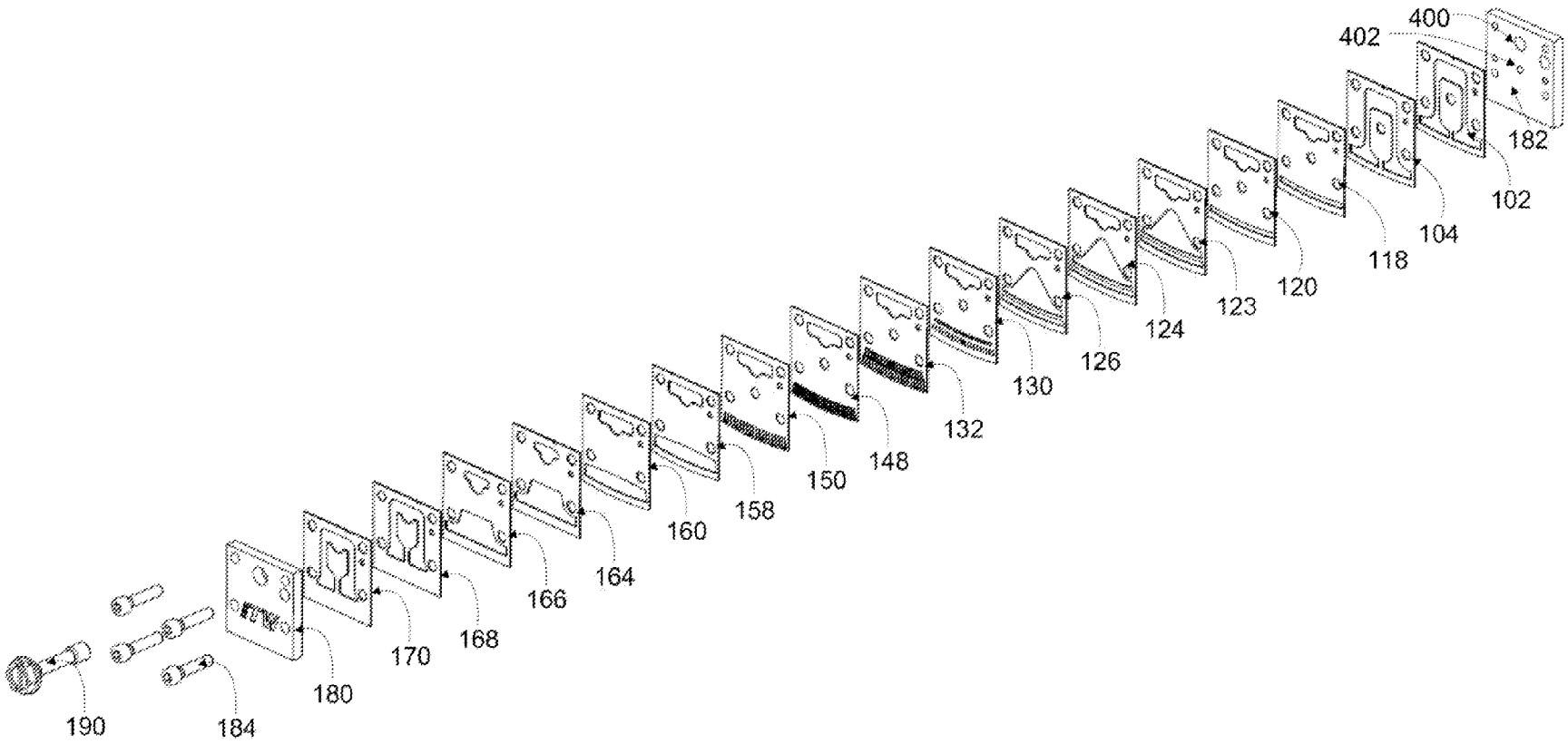
FIG. 1C is an expanded view of the die assembly of FIG. 1A.

FIG. 1C illustrates an expanded view of the die assembly 100. Each of the plates (102, 104, 118, 120, 123, 124, 126, 130, 132, 148, 150, 158, 160, 164, 166, 168, and 170) in the die assembly 100 are compressed between two end plates 180 and 182 and are secured in place by the securing units 184 with a fastener 190. When compressed together, the different openings in each plate align with corresponding openings in adjacent plates to form cavities and channels which direct the second fluid and first fluid through the die assembly 100.

Referring to FIGS. 1B and 2A-2H, the second fluid exits the second fluid inlet 400 and is split into two separate streams. The first stream travels through the channel formed from the second fluid inlet cavities 106 in each of the plates, and the second stream travels through the third restrictor cavity 122. The first stream travels the length of the die assembly 100, through the fluid inlet cavities 106, until the first stream reaches the end plate 180 where it is redirected back towards the second end plate 182 through the fluid return cavity 162 in the plates 166, 164, 158 and 160. When the first stream reaches plates 150 and 148, via the fluid return cavity 162, the first stream is directed through the second plurality of second slits 154 in the plate 148.

A second stream of the second fluid travels through the third restrictor cavity 122 in plates 118, 120, 123, 124 and 126 until the second stream is dispersed by the first plurality of second slits 154 in the plate 148. The first fluid exits the first fluid inlet 402 and passes through the channel created by the openings 116 until the first fluid reaches the accumulator cavity 128 in plates 123, 124 and 126. The first fluid accumulates in the accumulator cavity 128 such that a constant amount of the first fluid flows through the second orifices 136 in plate 130 and the third orifices 138 in the plate 132. The first fluid is the dispersed through the plurality of first slits 152 in the plate 148. The first and second fluids supplied to the die assembly 100, or body member, are distributed to the first and second slits 154 as discussed below.

Figure 2A:
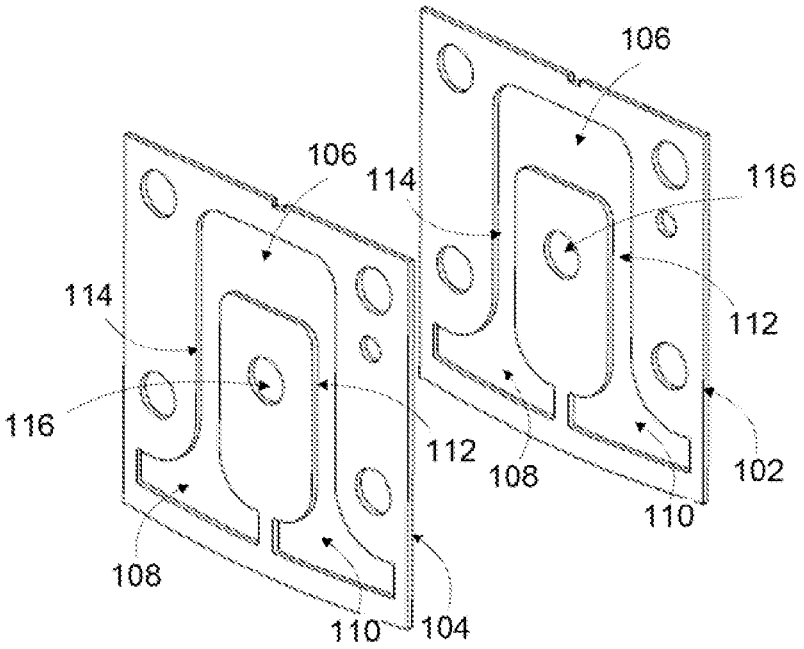
FIGS. 2A-2H illustrates the plates used in a die assembly of the quasi melt blow down system of FIG. 1A.

FIGS. 2A-2H show each of the plurality of plates in the die assembly 100. FIG. 2A shows two plates 102 and 104 which together form a fluid inlet cavity 106, a first restrictor cavity 108, and a second restrictor cavity 110 when plates 102 and 104 are pressed together. The second fluid is provided into the fluid inlet cavity 106 under a uniform pressure and is transferred to the first restrictor cavity 108 and second restrictor cavity 110 by channels 112 and 114. The first fluid is transferred through plates 102 and 104 by a channel created by the opening 116 in the plates 102 and 104.

Figure 2B:
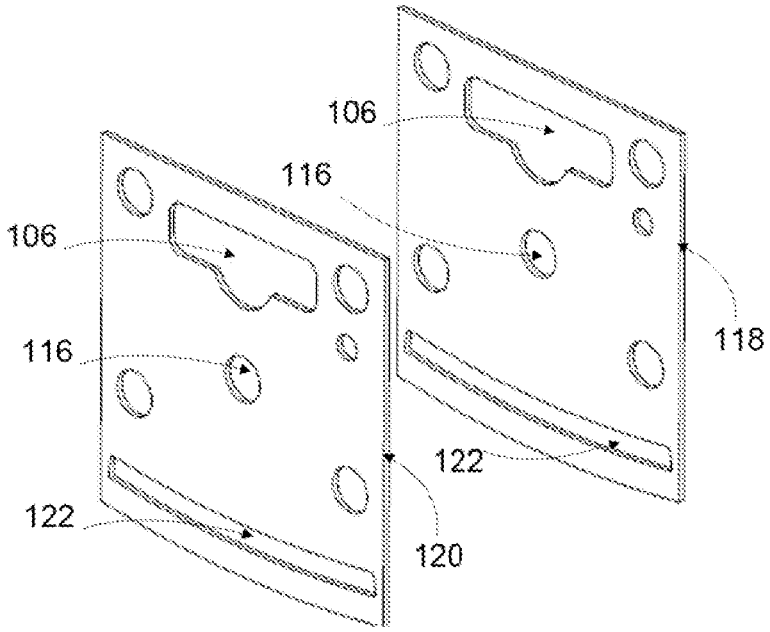

FIG. 2B shows two plates 118 and 120 with plate 118 being adjacent to plate 104. The second fluid passes through the fluid inlet cavity 106 in the two plates 118 and 120. The second fluid also passes from the first restrictor cavity 108 and second restrictor cavity 110 in the plates 102 and 104 through a third restrictor cavity 122 in the lower portion of each plate 118 and 120. The first fluid continues through the channel created by the opening 116 in each plate 118 and 120. The plates 118 and 120 are aligned such that the center of the opening 106 is aligned in each plate of the plurality of plates.

Figure 2C:
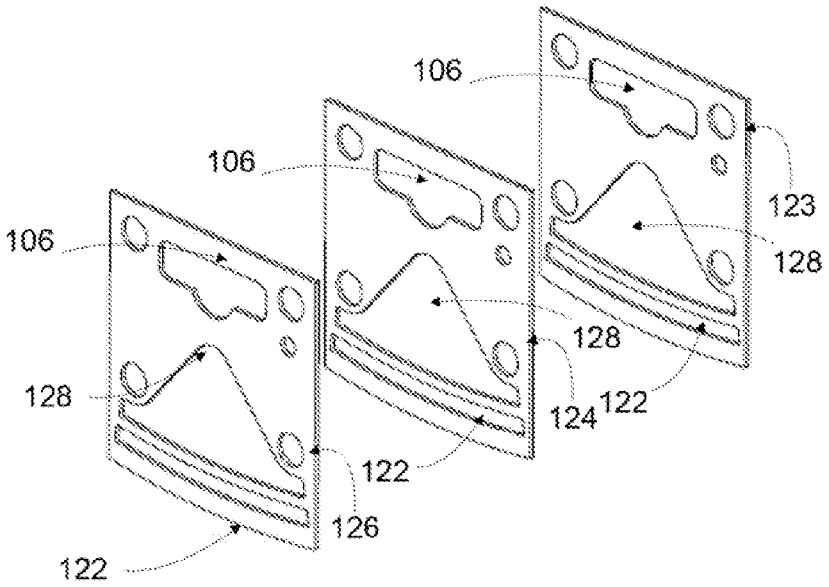

FIG. 2C shows three plates 123, 124 and 126 with plate 123 being adjacent to plate 120. The second fluid passes through the fluid inlet cavity 106 in plates 123, 124 and 126 from the fluid inlet cavity 106 in plates 118 and 120. The second fluid also passes through the third restrictor cavity 122 in the lower portion of each plate 123, 124 and 126 from the third restrictor cavity in plates 118 and 120. The first fluid enters an accumulator cavity 128 from the channel created by the openings 116 in plates 123, 124 and 126.

The accumulator cavity 128 is substantially parabolic in shape with the apex of the parabolic shape being closest to the fluid inlet cavity 106 in plates 123, 124 and 126. The portion of the accumulator cavity 128 closest to the third restrictor cavity 122 has a width approximately equal to the width of the third restrictor cavity 122.

Figure 2D:
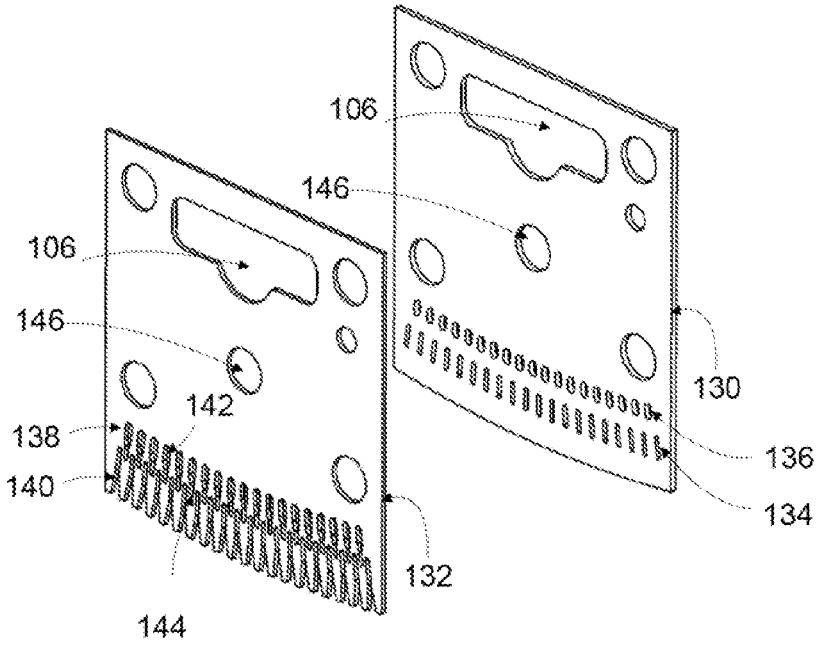

FIG. 2D shows two plates 130 and 132 with plate 132 being adjacent to the plate 126. The second fluid passes through the fluid inlet cavity 106 in plates 130 and 132. The second fluid also passes from third restrictor cavity 122 in plates 123, 124 and 126 into a plurality of first orifices 134 in plate 130. The plurality of first orifices 134 acts as a fluid filter for trapping any larger debris in the second fluid. The first fluid passes from the accumulator cavity 128 through a plurality of second orifices 136 positioned above the plurality of first orifices 134 in plate 130. Each of the plurality of second orifices 136 is positioned above each of the plurality of first orifices 134 and are aligned with a space between each of the plurality of first orifices 134.

The plurality of second orifices 136 in plate 130 are aligned with a plurality of third orifices 138 in plate 132 and the plurality of first orifices 134 in plate 130 are aligned with a plurality of first slots 140 in plate 132. The plurality of third orifices 138 each includes an upper portion 142 and a lower portion 144. The upper portion 142 is substantially oval shaped and is positioned above the plurality of first slots 140 and are aligned with a space between each of the plurality of first slots 140. Each of the upper portions 142 align with a corresponding second orifice 136 in plate 130. The lower portions 144 have a width smaller than the width of the upper portion 142 and extend from one end of the upper portion 142 into the space between each of the plurality of slots 140.

Each of the plurality of first slots 140 aligns with a corresponding first orifice 134 in plate 130 such that second fluid flows through each first orifice 134 and into a corresponding first slot 140. Each of the first slots 140 includes one open end and one closed end with the open end having a width larger than the width of the closed end. The first fluid also passes from the accumulator cavity 128 in plates 126 and 128 through a channel created by the openings 146 in plates 130 and 132.

Figure 2E:
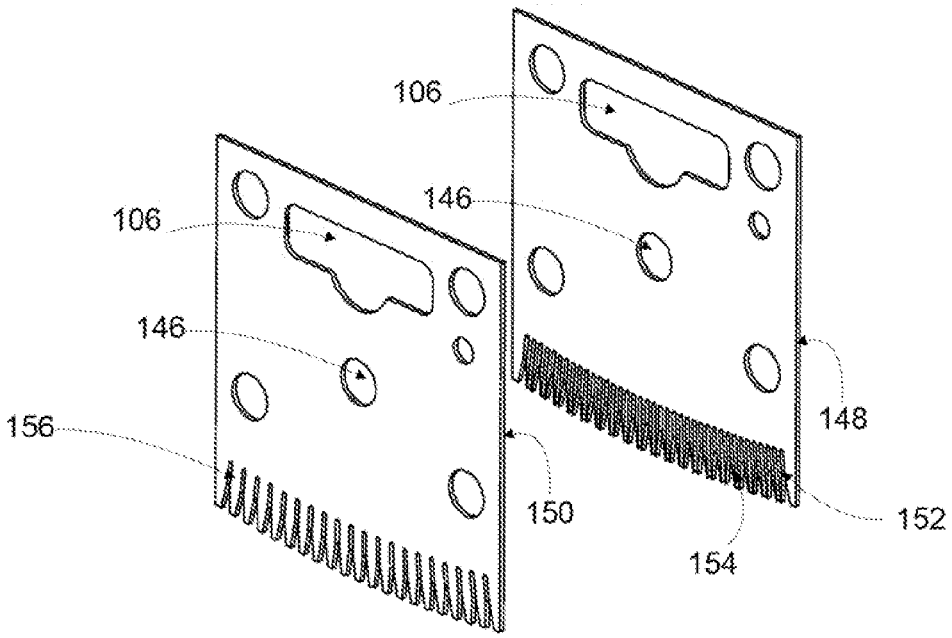

FIG. 2E illustrates plates 148 and 150 with plate 148 being adjacent to plate 132. The second fluid passes through the fluid inlet cavity 106 in plates 148 and 150 from the first fluid cavity 106 in plates 130 and 132. The second fluid also passes from the each of the plurality of first slots 140 in plate 132 into a first plurality of second slits 154 in the lower portion of plate 148. The first fluid passes through each of the plurality of second orifices 138 in plate 132 and into the plurality of first slits 152 in the lower portion of plate 148. The lower portion 144 of each orifice 138 is aligned with the upper portion of a corresponding slit 152 such that fluid enters each of the slits 152 from a top portion of each slit 152 from the lower portion 144 of each orifice 138. Each of the plurality of first slits 152 is alternated with each of the plurality of second slits 154 such that any one of the plurality of first slits 152 is adjacent to a corresponding second slit 154. Plate 150 includes a plurality of slits 156 which are arranged such that each of the slits 156 are aligned with a second plurality of the second slits 154 on plate 148, where the second plurality of second slits 154 are different than the first plurality of second slits 154.

Figure 2F:
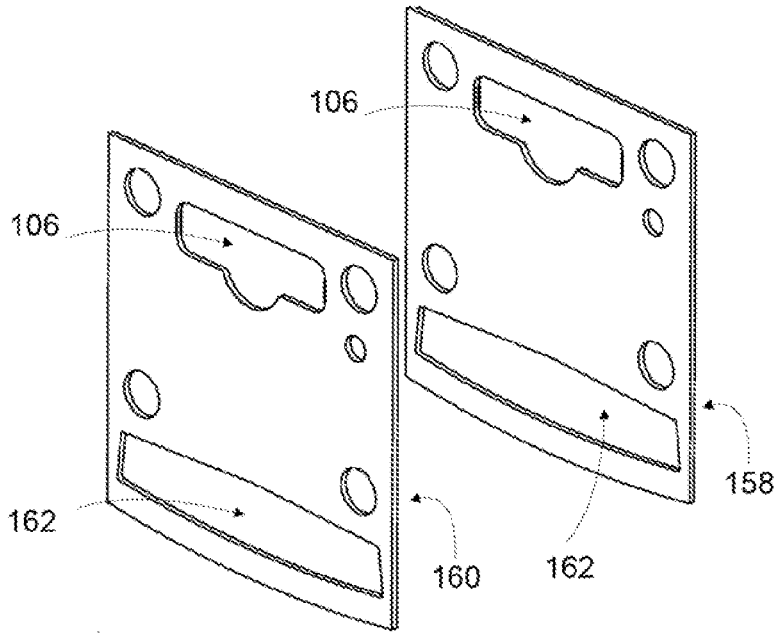

FIG. 2F shows plates 158 and 160 with plate 158 being adjacent to plate 150. The second fluid passes through the fluid inlet cavity 106 in plates 158 and 160 from first inlet cavity 106 in plates 148 and 150. The second fluid also passes through the fluid return cavity 162 from plate 160 to plate 158 such that the second fluid flows through the slits 156. Each of the slits 156 is aligned with a second plurality of second slits 154 in plate 148. Because of this arrangement, the second fluid is provided to different slits from different directions, as will described herein. When combined, the second fluid and first fluid pass through slits 152 and 154 at a rate of approximately 2-3 grams per slit per minute consuming approximately 8.0 cubic feet per minute of air for every two inches of fluid passed.

Figure 2G:
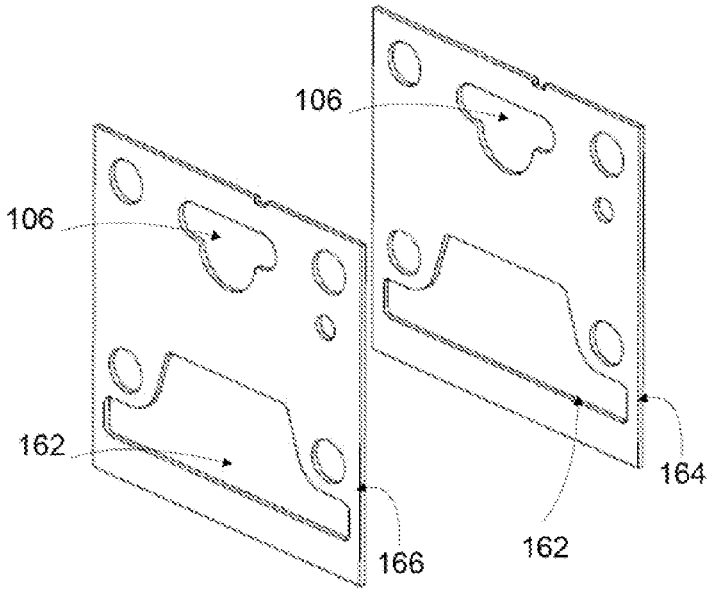

FIG. 2G shows plates 164 and 166 with plate 164 being adjacent to plate 160. The second fluid passes through the fluid inlet cavity 106 in plates 164 and 166 from the first fluid inlet cavity 106 in plates 158 and 160. The second fluid also passes from plate 166 to plate 164 through the fluid return cavity 162.

Figure 2H:
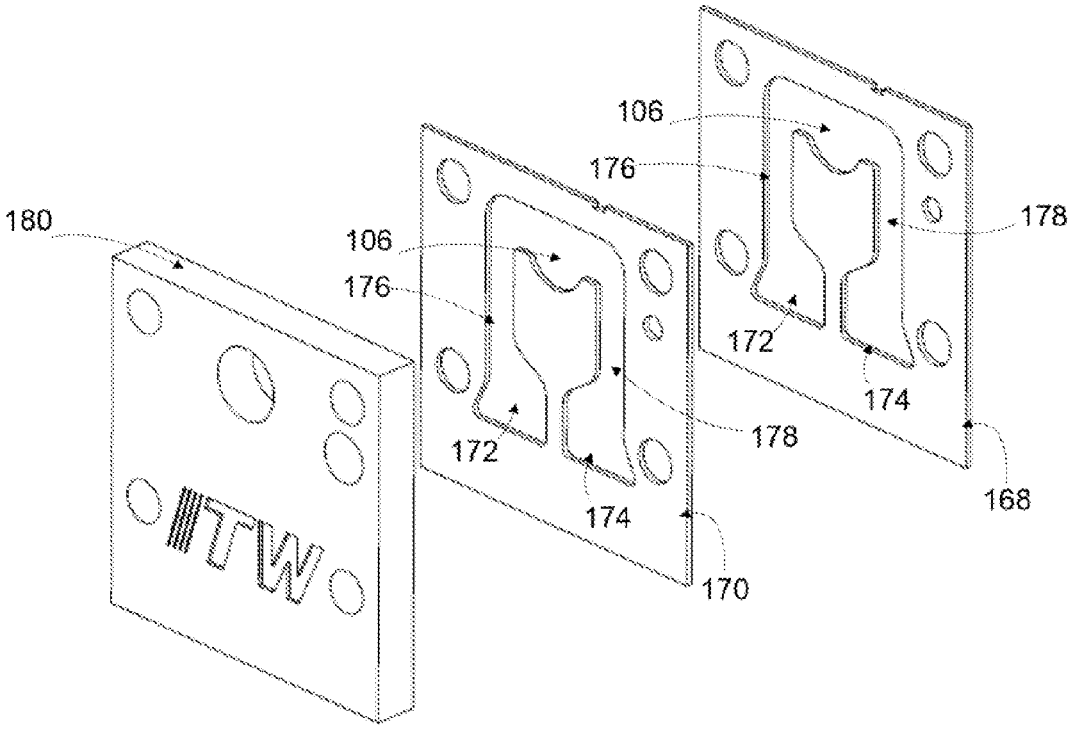

FIG. 2H shows plates 168 and 170 with plate 168 being adjacent to plate 166. The second fluid passes from the fluid inlet cavity 106 in plate 166 through the fluid inlet cavity 106 in plates 168 and 170. The fluid inlet cavity 106 in plates 168 and 170 are connected to a first return restrictor channel 172 and second return restrictor cavity 174 by channels 176 and 178 respectively. The second fluid is collected in the first and second return restrictor channels 172 and 174 and is then passed through the fluid return cavity 162 in plates 166, 164, 160 and 158 until the second fluid is dispersed by the second plurality of second slits 154 in plate 148, as previously discussed. The first end plate 180 is positioned adjacent to plate 170.

The plurality of plates are affixed together by the first end plate 180 and a second end plate 182, as shown in FIG. 1A. Securing units 184 (four shown, see, FIG. 7) engage openings 186 positioned near the corners of the end plates 180 and 182 and in each of the plurality of plates. The securing units 184 can be a rivet, screw, pin or any other device capable of securing the plurality of plates and end plates 180 and 182 together.

FIG. 1A also shows the die assembly 100 retained between the first and second end plates 180 and 182 and coupled to an adapter assembly 300. The illustrated adapter assembly 300 includes an adapter 310 and an intermediate adapter 320. FIGS. 3A-4C show various views of the adapter 310 having a first interface 312 for mounting either the die assembly 100 compressably retained between the end plates 180 and 182 directly or alternatively for mounting the intermediate adapter 320 as shown in the exemplary embodiment. The mounting interface 312 of the adapter 310 includes a second fluid outlet 314 coupled to a corresponding second fluid inlet 315, and a first fluid outlet 316 coupled to a corresponding first fluid inlet 317. The intermediate adapter 320 has a first mounting surface 322 with first and second fluid inlets 324 and 326 coupled to corresponding first and second fluid outlets 325 and 327 on a second mounting interface 321. The first mounting surface 322 of the intermediate adapter 320 is mountable on the first mounting interface 312 of the adapter 310 to couple the first and second fluid inlets 324 and 326 of the intermediate adapter 320 to the first and second fluid outlets 314 and 316 of the adapter 310.

Figure 3A:
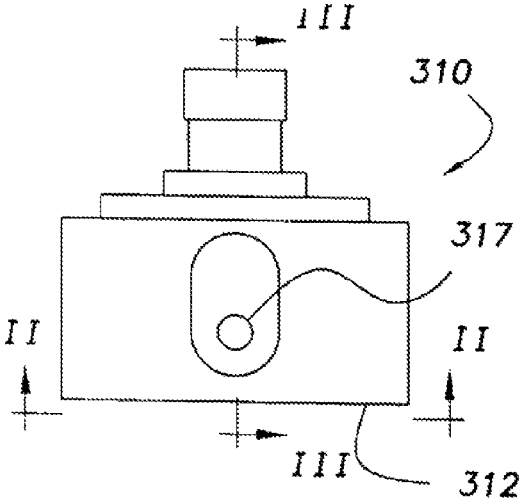
FIG. 3A is front view of a die assembly adapter of the quasi melt blow down system of FIG. 1A.
Figure 3C:
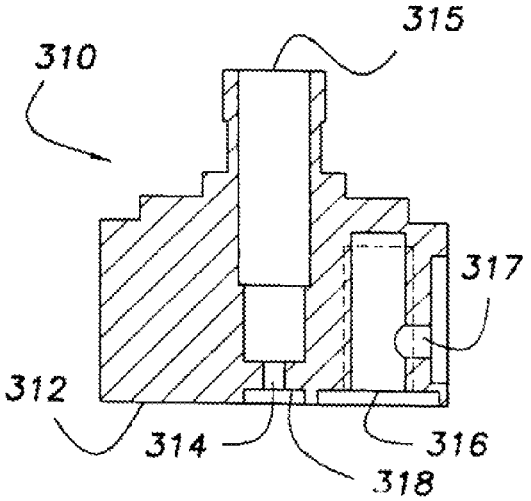
FIG. 3C is sectional view along line III-III of FIG. 3A.
Figure 3B:
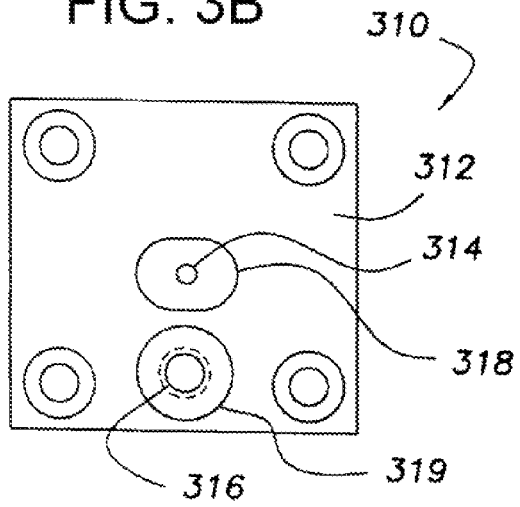
FIG. 3B is an end view along line II-II of FIG. 3A.
Figure 4A:
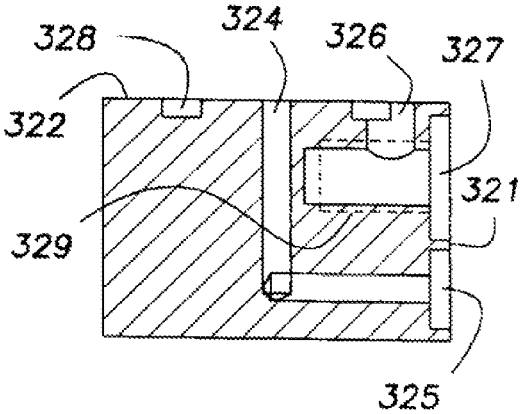
FIG. 4A is a sectional view along line IV-IV of FIG. 4B of showing an intermediate adapter coupleable with the adapter of FIG. 3A.
Figure 4B:
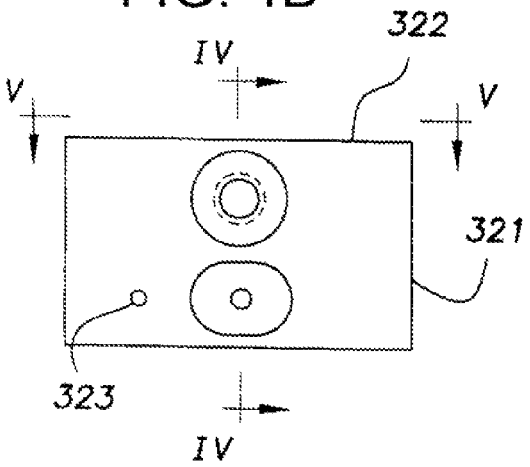
FIG. 4B is a front view of the intermediate adapter of FIG. 4A.
Figure 4C:
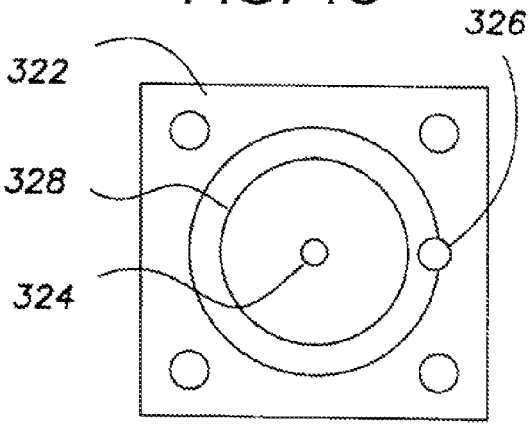
FIG. 4C is a top plan view along line V-V of the intermediate adapter of FIG. 4B.

According to another aspect, as shown in FIGS. 3B, 4A and 4C, the first fluid outlet 314 of the adapter 310 is located centrally thereon for coupling with a centrally located second fluid inlet 324 of the intermediate adapter 320. The second fluid outlet 316 of the adapter 310 is located radially relative to the first fluid outlet 314 for coupling with a recessed annular first fluid inlet 328 coupled to the second fluid inlet 326 and disposed about the first fluid inlet 324 on the first interface 322 of the intermediate adapter 320. Accordingly, the intermediate adapter 320 is rotationally adjustable relative to the adapter 310 to adjustably orient the die assembly 100 to permit alignment of the die assembly parallel or non-parallel to the direction F of substrate movement. And, according to a related aspect, the adapter 310 also has a recessed annular first fluid inlet disposed about the first fluid inlet 315 and coupled to the second fluid outlet 316, such that the adapter 310 is rotationally adjustable relative to a nozzle module 240 or other adapter for coupling the die assembly 100 to a second fluid supply as discussed further herein.

FIGS. 3B and 3C show the first interface of one of the adapter 310 or intermediate adapter 320 having first and second sealing member recesses 318 and 319 disposed about the first and second fluid outlets 314 and 316 on the first interface 312 of the adapter 310. A corresponding resilient sealing member like a rubber O-ring, not shown but known in the art, is seatable in each recess for forming a fluid seal between the adapter 310 and the intermediate adapter 320.

The exemplary recesses are enlarged relative to the first and second fluid outlets 314 and 316 to accommodate misalignment between the adapter 310 and the intermediate adapter 320 and additionally to prevent contact between the second fluid and the sealing member, which may result in premature seal deterioration. Also, some of the recesses are oval shaped to more efficiently utilize the limited surface area of the mounting interface 312. The second fluid inlet 317, and other interfaces, generally have a similar sealing member recess for forming a fluid seal with corresponding mounting members not shown.

FIG. 1A also shows a metal sealing member, or gasket, 330 that can be positioned between the adapter 310 and the intermediate adapter 320 for use in combination with the resilient sealing member discussed above or as an alternative thereto. The metal sealing member 330 includes, generally, first and second fluid coupling ports, which may be enlarged to accommodate the resilient sealing members discussed above, and holes for passing bolt members there through during coupling of the adapter 310 and intermediate adapter 320.

Figure 5:
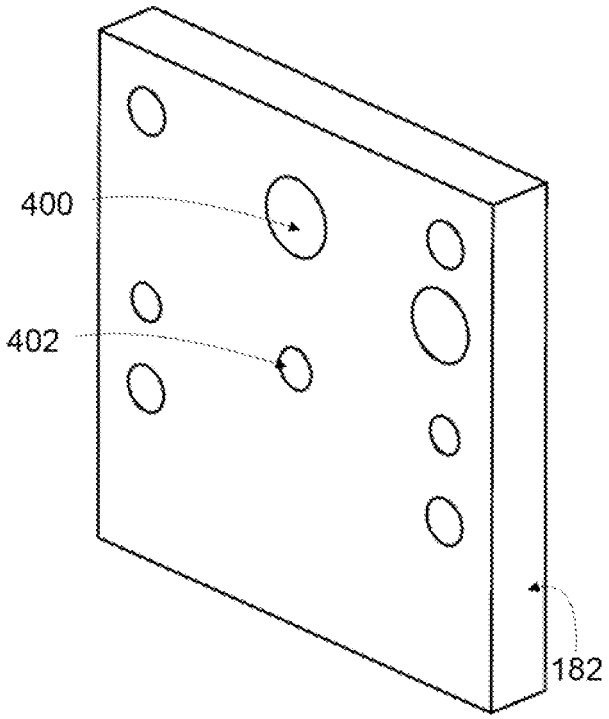
FIG. 5 is front view of the second end plate.

As discussed herein, the die assembly 100 compressably retained between the first and second end plates 180 and 182 can be coupled either directly to the adapter 310 or to the intermediate adapter 320, to permit mounting the die assembly 100 in a parallel or vertical orientation or in orientations shifted 90 degrees. FIG. 1A shows the die assembly 100 and end plates 180 and 182 mounted on the second mounting interface 321 of the intermediate adapter 320. FIG. 5 shows the second die retaining end plate 182 having a second fluid inlet 400 and a first fluid inlet 402 for coupling the first and second fluid inlet cavities 106 and 116 of the die assembly 100 to the first and second fluid outlets 325 and 327 of the intermediate adapter 320.

FIG. 1A also shows a fastener 190 for fastening the die assembly 100 retained between the end plates 180 and 182 to the mounting surface of the adapter 320. The fastener 190 includes an enlarged head portion 192 with a torque applying engagement surface, a narrowed shaft portion 194, and a threaded end portion 196.

Figure 6:
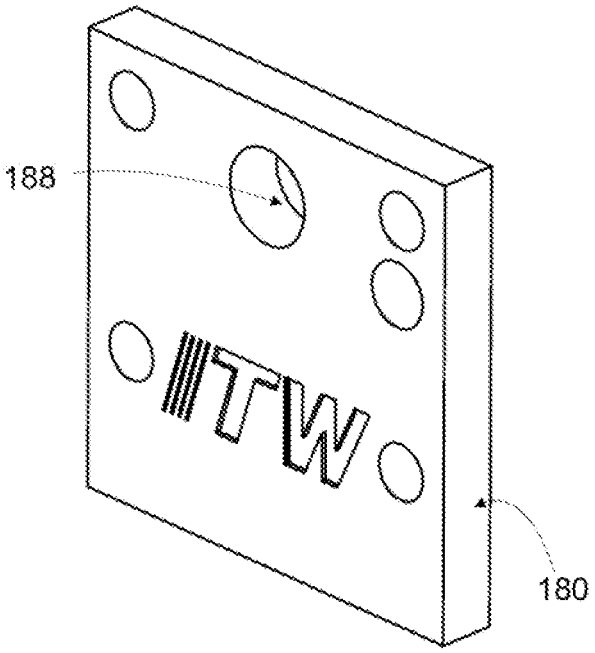
FIG. 6 is a front view of a first end plate.

FIG. 6 shows the first end plate 180 having an opening 188 for freely passing the threaded end portion 196 of the fastener 190 therethrough, and a seat for receiving a sealing member, not shown, which forms a fluid seal with the enlarged head portion 192 of the fastener 190 advanced fully through the die assembly 100. The threaded end portion 196 of the fastener 190 is also freely passable through the first fluid inlet 106 of the die assembly 100, through the second fluid inlet 400 in the second end plate 182, and into threaded engagement with a portion 329 of the first fluid outlet 327 of the intermediate adapter 320. Accordingly, the fastener 190 is disposed through and into the first fluid outlet 327 of the adapter 320, or adapter 310 which is configured similarly, to fasten the die assembly 100 compressably retained between the first and second end plates 180 and 182, so that the narrowed shaft portion 194 of the fastener 190 permits the first fluid flow therethrough without obstruction.

The second fluid inlet 400 in the second end plate 182 is threaded to engage the threaded end portion 196 of the fastener, thus preventing separation thereof during assembly of the die assembly 100 and the end plates 180 and 182. As such, the fastener 190 extends through an upper portion of the die assembly 100 and the end plates 180 and 182 to facilitate mounting thereof onto the mounting interface of the adapter 310 or 320. This upward location of the fastener 190 allows gravitational orientation of the die assembly relative to the adapter when mounting to substantially vertically oriented mounting interfaces. The adapter mounting interface and the second end plate 182 may also have complementary members for positively locating the second end plate 182 on the mounting interface.

To this end, as shown in FIG. 1A, the die assembly 100 is coupled to a fluid metering device 210 for supplying the second fluid to the die assembly. The die assembly is fluidically coupled to the main manifold 200 having a second fluid supply conduit 230 that is fluidically coupled between the fluid metering device 210 and the die assembly 100 to supply second fluid thereto. The exemplary embodiment shows, more generally, accommodations for mounting a plurality of die assemblies 100 fluidically coupled to the main manifold 200, so that the main manifold has a plurality of second fluid supply conduits 230 fluidically coupled between the fluid metering device 210 and a corresponding one of the plurality of die assemblies 100 to supply second fluid thereto. The second fluid supply conduits 230 are fluidically coupled to a plurality of corresponding fluid outlet ports 232 disposed on a first end portion 202 of the main manifold 200.

It should be understood that various changes and modifications to the presently disclosed embodiments will be apparent to those skilled in the art. Such changes and modifications can be made without departing from the spirit and scope of the present disclosure and without diminishing its intended advantages. It is therefore intended that such changes and modifications be covered by the appended claims.

The invention claimed is:

1. A melt blown system including:

a die assembly having a plurality of thin plates compressed together and secured between opposing end plates;

a first channel in the die assembly for carrying a first fluid;

a first cavity formed contiguously in one or more of the thin plates fluidically coupled to the first channel that is configured to collect the first fluid, the first cavity defining an accumulator cavity;

an inlet channel formed contiguously in one or more of the thin plates configured to receive a second fluid from a fluid inlet in one of the opposing end plates;

a first orifice formed contiguously in one or more of the thin plates configured to receive the second fluid from the inlet channel and carry the second fluid through the die assembly;

a second orifice formed contiguously in one or more of the thin plates configured to receive the second fluid from the inlet channel;

a plurality of first nozzles in the die assembly that are fluidically coupled to the first orifice, the plurality of first nozzles comprising a first plurality of first slits;

a plurality of second nozzles in the die assembly that are fluidically coupled to the second orifices, the plurality of second nozzles comprising a second plurality of first slits different from the first plurality of first slits; and a plurality of third nozzles in the die assembly that are fluidically coupled to the accumulator cavity, the plurality of third nozzles comprising a plurality of second slits, wherein third nozzles of the plurality of third nozzles are spaced apart along a first path and at least one of first nozzles of the plurality of first nozzles and second nozzles of the plurality of second nozzles are alternately positioned between the third nozzles along the first path, wherein the first plurality of first slits, the second plurality of first slits and the plurality of second slits are formed on a same thin plate of the plurality of thin plates.

2. The melt blown system of claim 1 wherein the first nozzles receive the second fluid from a side of each first nozzle closest to a second end plate.

3. The melt blown system of claim 1 wherein the second nozzles receive the second fluid from a side of each second nozzle closest to a first end plate.

4. The melt blown system of claim 2 wherein each of the third nozzles are adjacent to one first nozzle and one second nozzle on opposing sides of each third nozzle.

5. The melt blown system of claim 1 wherein the first fluid is a metallocene based thermo-plastic polymer.

6. The melt blown system of claim 5 wherein the metallocene based thermo-plastic polymer includes at least one of polypropylene, polyethylene, nylon 6 and selected polyesters.

7. The melt blown system of claim 1 wherein the second fluid is heated air.

8. The melt blown system of claim 1 wherein the nozzles are controlled to apply fine fiber layers to an existing substrate.

9. The melt blown system of claim 1 wherein the nozzles and orifices are formed in the plurality of thin plates that are compressed together by the opposing end plates.

10. The melt blown system of claim 1 wherein a mass flow rate from the first and second nozzles is greater than a mass flow rate from the third nozzle.

11. The melt blown system of claim 1 wherein the first fluid and second fluid are dispensed on a previously formed melt-blown or spunlaid fabric layer.

12. The melt blown system of claim 1, wherein the plurality of first nozzles, the plurality of second nozzles and the plurality of third nozzles are positioned in series with each other.

* * * * *